US011585102B2

(12) United States Patent
Cormier et al.

(10) Patent No.: US 11,585,102 B2
(45) Date of Patent: Feb. 21, 2023

(54) LOAD DISTRIBUTION AND ABSORPTION UNDERPAYMENT SYSTEM

(71) Applicant: VICONIC SPORTING LLC, Dearborn, MI (US)

(72) Inventors: Joel Matthew Cormier, Lathrup Village, MI (US); Jackson Alexander Elliott, Plymouth, MI (US); Richard Francois Audi, Dearborn, MI (US); Donald Scott Smith, Commerce, MI (US)

(73) Assignee: VICONIC SPORTING LLC, Dearborn, MI (US)

( * ) Notice: Subject to any disclaimer, the term of this patent is extended or adjusted under 35 U.S.C. 154(b) by 51 days.

(21) Appl. No.: 16/182,931

(22) Filed: Nov. 7, 2018

(65) Prior Publication Data

US 2020/0141131 A1 May 7, 2020

(51) Int. Cl.

| | |
|---|---|
| ***E04F 15/22*** | (2006.01) |
| ***A47G 27/02*** | (2006.01) |
| ***E04F 15/02*** | (2006.01) |
| ***E04F 13/07*** | (2006.01) |
| ***E04H 3/08*** | (2006.01) |
| ***E04H 3/10*** | (2006.01) |

(Continued)

(52) U.S. Cl.

CPC ..... *E04F 15/225* (2013.01); *A47G 27/0218* (2013.01); *A47G 27/0231* (2013.01); *A47G 27/0287* (2013.01); *E01C 13/02* (2013.01); *E02B 3/068* (2013.01); *E04F 13/07* (2013.01); *E04F 15/02038* (2013.01); *E04H 1/02* (2013.01); *E04H 3/08* (2013.01); *E04H 3/10* (2013.01); *E04H 5/00* (2013.01); *E04H 9/06* (2013.01); *E04F 2290/044* (2013.01)

(58) Field of Classification Search

CPC ... E04F 15/225; E04F 13/07; E04F 15/02183; E04F 2290/044; B60N 2/42; E04H 3/08; E04H 3/14; E04H 1/02; E02B 3/068; F42D 5/05; A47G 27/0218; A47G 27/0231; A47G 27/0287; A47G 27/02

USPC ..... 52/177, 403.1, 480, 591.4

See application file for complete search history.

(56) References Cited

U.S. PATENT DOCUMENTS

| | | | |
|---|---|---|---|
| 1,784,511 | A | 12/1930 | Carns |
| 1,958,050 | A | 5/1934 | Koppelman |

(Continued)

FOREIGN PATENT DOCUMENTS

| | | |
|---|---|---|
| EP | 1422344 | 11/2002 |
| EP | 2154291 | 2/2010 |

(Continued)

OTHER PUBLICATIONS

US 7,624,546 B2, 01/2009, Moller, Jr. (withdrawn)

*Primary Examiner* — Brian E Glessner
*Assistant Examiner* — Adam G Barlow
(74) *Attorney, Agent, or Firm* — Brooks Kushman P.C.

(57) ABSTRACT

A load distributing and absorbing system that lies below a superstructure material which is exposed to percussive forces. The load distributing and absorbing system is interposed between the superstructure material and a foundation. The system has a barrier layer that lies below the superstructure material and an underlayment infrastructure positioned below the barrier layer. Included in the underlayment infrastructure are hat-shaped absorbing members.

16 Claims, 6 Drawing Sheets

(51) Int. Cl.

| | |
|---|---|
| ***E04H 5/00*** | (2006.01) |
| ***E04H 9/06*** | (2006.01) |
| ***E01C 13/02*** | (2006.01) |
| ***E02B 3/06*** | (2006.01) |
| ***E04H 1/02*** | (2006.01) |

(56) References Cited

U.S. PATENT DOCUMENTS 1,995,728 A 3/1935 Aldrich
2,090,881 A 8/1937 Wilson
2,225,067 A 12/1940 Marin
2,275,575 A 3/1942 Vrooman
2,349,907 A 5/1944 Kos et al.
2,391,997 A 1/1946 Noble
2,434,641 A 1/1948 Burns
2,924,419 A 2/1960 Wells
3,011,602 A 12/1961 Ensrud et al.
3,018,015 A 1/1962 Agriss et al.
3,071,216 A 1/1963 Jones et al.
3,108,924 A * 10/1963 Adie ..... E04C 2/3405 52/789.1
3,196,763 A 7/1965 Rushton
3,204,667 A 9/1965 Zahorski
3,231,454 A * 1/1966 Williams ..... B65D 81/03 297/DIG. 8
3,290,848 A * 12/1966 Moss ..... E04B 9/0478 52/591.4
3,525,663 A 8/1970 Hale
3,597,891 A 8/1971 Martin
3,605,145 A 9/1971 Graebe
3,802,790 A 4/1974 Blackbum
3,828,715 A 8/1974 Matsushita
3,834,487 A * 9/1974 Hale ..... E04C 2/3405 428/116
3,871,636 A 3/1975 Boyle
3,876,492 A 4/1975 Schnott
3,933,387 A 1/1976 Salloum et al.
3,938,963 A 2/1976 Hale
3,980,221 A 9/1976 Okada
3,997,207 A 12/1976 Norlin
4,018,025 A * 4/1977 Collette ..... E04F 15/02188 52/302.3
4,029,280 A 6/1977 Golz
4,029,350 A 6/1977 Goupy et al.
4,190,276 A 2/1980 Hirano et al.
4,233,793 A 11/1980 Omholt
4,321,989 A 3/1982 Meinzer
4,352,484 A 10/1982 Gertz et al.
4,413,856 A 11/1983 McMahan et al.
4,530,197 A 7/1985 Rainville
4,631,221 A 12/1986 Disselbeck et al.
4,635,981 A 1/1987 Friton
4,666,130 A 5/1987 Denman et al.
4,696,401 A 9/1987 Wallace
4,710,415 A 12/1987 Slosberg et al.
4,720,261 A 1/1988 Fishwick et al.
4,739,762 A 4/1988 Palmaz
4,755,416 A 7/1988 Schneider et al.
4,757,665 A 7/1988 Hardigg
4,844,213 A 7/1989 Travis
4,869,032 A 9/1989 Geske
4,879,857 A * 11/1989 Peterson ..... E04F 15/225 52/480
4,890,877 A 1/1990 Ashtiani-Zarandi et al.
4,909,661 A 3/1990 Ivey
4,980,877 A 12/1990 Sugiyama et al.
5,030,501 A 7/1991 Colvin et al.
5,033,593 A 7/1991 Kazuhito
5,054,753 A 10/1991 Polus
5,085,424 A 2/1992 Wood, Jr.
5,141,279 A 8/1992 Weller
5,165,990 A 11/1992 Nakano
5,192,157 A 3/1993 Laturner
5,306,066 A 4/1994 Saathoff
5,364,682 A 11/1994 Tanaka et al.
5,383,314 A * 1/1995 Ro ..... E02D 31/02 428/128
5,390,467 A * 2/1995 Shuert ..... B29C 51/267 52/789.1
5,391,251 A * 2/1995 Shuert ..... B65D 19/0026 264/545
5,399,406 A * 3/1995 Matsuo ..... B60R 21/04 52/630
5,401,347 A 3/1995 Shuert
5,435,619 A 7/1995 Nakae et al.
5,444,959 A 8/1995 Tesch
5,500,037 A 3/1996 Alhamad
5,518,802 A 5/1996 Colvin et al.
5,551,673 A 9/1996 Furusawa et al.
5,573,272 A 11/1996 Teshima
5,619,832 A * 4/1997 Myrvold ..... E02D 31/02 52/630
5,636,866 A 6/1997 Suzuki et al.
5,660,426 A 8/1997 Sugimori et al.
5,679,967 A 10/1997 Janai et al.
5,700,545 A 12/1997 Audi et al.
5,727,826 A 3/1998 Frank et al.
5,744,763 A 4/1998 Iwasa et al.
5,762,392 A 6/1998 Suga
5,833,386 A 11/1998 Rosan et al.
5,972,477 A 10/1999 Kim et al.
6,017,084 A 1/2000 Carroll, III et al.
6,199,942 B1 3/2001 Carroll, III et al.
6,205,728 B1 3/2001 Sutelan
6,221,292 B1 4/2001 Carroll, III
6,247,745 B1 6/2001 Carroll, III et al.
6,315,339 B1 11/2001 Devilliers et al.
6,318,755 B1 11/2001 Nusser et al.
6,443,513 B1 9/2002 Glance
6,547,280 B1 4/2003 Ashmead
6,679,544 B1 1/2004 Hubbert et al.
6,682,128 B2 1/2004 Carroll, III et al.
6,687,907 B1 1/2004 Le
6,715,592 B2 4/2004 Suzuki et al.
6,752,450 B2 * 6/2004 Carroll, III ..... B65D 81/127 293/133
6,763,322 B2 7/2004 Potyrailo et al.
6,777,062 B2 * 8/2004 Skaja ..... E01C 13/045 428/165
6,820,386 B2 * 11/2004 Kappeli ..... E04F 15/02 52/591.4
RE38,745 E * 6/2005 Foster ..... B32B 27/32 428/318.6
6,938,290 B2 9/2005 McKinney et al.
7,033,666 B2 * 4/2006 Skaja ..... F16F 3/0935 428/72
7,143,876 B2 12/2006 Tamada et al.
7,163,244 B2 1/2007 Meltzer
7,249,662 B2 7/2007 Itou
7,360,822 B2 4/2008 Carroll, III et al.
7,377,577 B2 5/2008 Carroll, III et al.
7,384,095 B2 6/2008 Cormier et al.
7,416,775 B2 8/2008 Snel
7,441,758 B2 10/2008 Coffield et al.
7,488,523 B1 2/2009 Muncaster et al.
7,574,760 B2 8/2009 Foley et al.
7,575,796 B2 * 8/2009 Scott ..... E04F 15/105 428/44
7,625,023 B2 12/2009 Audi et al.
7,690,160 B2 4/2010 Moller, Jr.
7,810,291 B2 10/2010 McPherson
7,866,248 B2 1/2011 Moore, III et al.
7,900,416 B1 * 3/2011 Yokubison ..... E04F 15/087 52/592.1
7,908,802 B2 * 3/2011 Frederiksen ..... E01C 5/20 52/177
7,958,681 B2 * 6/2011 Moller, Jr. ..... E01C 5/20 52/592.1
8,061,098 B2 * 11/2011 Whelan ..... B32B 33/00 52/409
D654,748 S * 2/2012 Lu ..... D6/582
8,221,856 B2 7/2012 Stroppiana

(56) References Cited

U.S. PATENT DOCUMENTS 8,458,987 B2 * 6/2013 Becker ..... B32B 27/08 428/172
8,465,087 B2 6/2013 Gerwolls et al.
8,528,280 B2 9/2013 Coil et al.
8,568,840 B2 10/2013 Sawyer et al.
8,726,424 B2 5/2014 Thomas et al.
8,777,191 B2 7/2014 Kligerman et al.
8,915,339 B2 12/2014 Kanous et al.
8,919,069 B2 12/2014 Bird et al.
8,998,298 B2 * 4/2015 Gerwolls ..... F16F 7/128 296/146.7
9,194,136 B2 11/2015 Cormier et al.
9,249,853 B2 * 2/2016 Cormier ..... B60R 13/0815
9,279,258 B2 * 3/2016 Cormier ..... F16F 1/445
9,394,702 B2 * 7/2016 Cormier ..... E04F 15/22
9,420,843 B2 8/2016 Cormier et al.
9,462,843 B2 10/2016 Cormier et al.
9,528,280 B2 12/2016 Cormier et al.
9,622,534 B2 4/2017 Cormier et al.
9,644,699 B2 * 5/2017 Cormier ..... B60R 21/04
10,047,484 B2 8/2018 Sawyer
10,220,736 B2 * 3/2019 Cormier ..... B60N 2/24
2002/0017805 A1 2/2002 Carroll, III et al.
2003/0154676 A1 * 8/2003 Schwartz ..... E04F 15/02138 52/592.1
2005/0133324 A1 6/2005 Soto Bailon et al.
2005/0158123 A1 7/2005 Ianniello et al.
2005/0200062 A1 * 9/2005 Maurer ..... F16F 7/12 267/144
2005/0281987 A1 12/2005 Starke
2007/0163194 A1 * 7/2007 Stone ..... B32B 3/02 156/289
2009/0165414 A1 * 7/2009 Burk ..... E04F 15/225 52/403.1
2010/0203292 A1 8/2010 Seth et al.
2010/0229486 A1 * 9/2010 Keene ..... E04F 15/182 52/309.1
2010/0313510 A1 * 12/2010 Tang ..... E04F 15/182 52/578
2011/0135852 A1 * 6/2011 Sawyer ..... E01C 3/06 428/17
2012/0055108 A1 * 3/2012 Bierwirth ..... E04F 15/182 52/403.1
2013/0291457 A1 * 11/2013 Tillery ..... E04F 15/107 52/177
2014/0000202 A1 * 1/2014 Dixon ..... E04F 15/182 52/403.1
2014/0007761 A1 1/2014 Haidar
2014/0190103 A1 * 7/2014 Sawyer ..... E01C 13/04 52/302.1
2014/0287843 A1 9/2014 Craven
2014/0133075 A1 10/2014 Cormier et al.
2014/0311074 A1 * 10/2014 Cormier ..... E04F 15/225 267/141
2014/0311075 A1 * 10/2014 Cormier ..... F41H 1/04 267/141
2015/0059276 A1 * 3/2015 Valentine ..... E04F 15/225 52/403.1
2016/0123021 A1 * 5/2016 Cormier ..... E01C 13/02 52/403.1
2016/0138275 A1 * 5/2016 Cormier ..... E01C 13/045 52/403.1
2016/0177562 A1 6/2016 Cormier et al.
2017/0101789 A1 * 4/2017 Cormier ..... E04F 15/22
2017/0362840 A1 * 12/2017 Paul ..... H05B 45/20
2018/0030667 A1 * 2/2018 Penland, Jr. ..... B32B 3/06
2018/0073254 A1 * 3/2018 Hain ..... B32B 3/02
2018/0080235 A1 * 3/2018 Downey ..... E04F 15/22
2018/0111518 A1 4/2018 Cormier et al.
2018/0202150 A1 * 7/2018 Downey ..... B32B 27/365
2018/0355561 A1 * 12/2018 Sawyer ..... E01C 5/001
2019/0136548 A1 * 5/2019 Jang ..... B32B 25/08
2019/0338512 A1 * 11/2019 Downey ..... B32B 27/365
2020/0149292 A1 * 5/2020 Downey ..... B32B 5/20

FOREIGN PATENT DOCUMENTS

FR 2209867 7/1974
JP 08085404 4/1996
JP 9150692 6/1997
JP 11348699 12/1999
KR 101011907 2/2011
KR 101363159 2/2014
WO 8203099 9/1982
WO 9300845 1/1993
WO 9711825 4/1997
WO 0031434 6/2000
WO 2006038029 4/2006
WO 2013183989 12/2013
WO 2014/174433 10/2014

* cited by examiner

LOAD DISTRIBUTION AND ABSORPTION UNDERPAYMENT SYSTEM

CROSS REFERENCE TO RELATED APPLICATIONS

This patent application is related to the following cases, the contents of which are incorporated by reference herein: U.S. Pat. No. 9,394,702 issued Jul. 19, 2016; U.S. Pat. No. 9,528,280 issued Dec. 27, 2016; U.S. application Ser. No. 15/388,304 filed Dec. 22, 2016, now U.S. Pat. No. 10,369,739 issued Aug. 6, 2019; U.S. application Ser. No. 15/333,291 filed Oct. 25, 2016, now U.S. Pat. No. 10,200,736 issued Mar. 5, 2019; and U.S. patent application Ser. No. 15/682,956 filed Aug. 22, 2017, now U.S. Pat. No. 10,788,091 issued Sep. 29, 2020.

BACKGROUND OF THE INVENTION

(1) Field of the Invention

Several aspects of this disclosure relate to a load distribution and absorption underlayment system, primarily for comfort underfoot and injury mitigation in such environments of use as an elder care or senior living facility.

(2) Background

Fall-related injuries among the ever-growing North American elderly population are a major health concern. In the United States, nearly 340,000 hip fractures occur per year, more than 90% of which are associated with falls. It is estimated that this number may double or triple by the middle of the century. The repercussions of hip fracture among the elderly add to the concern surrounding the issue. Over 25% of hip fracture patients over 65 years of age die within 1 year of the injury, and more than 50% suffer major declines in mobility and functional independence.

Traumatic brain injuries (TBI) also make up a significant portion of fall-related injuries; seniors are hospitalized twice as often as the general population for fall-related TBI. The incidence of fall-induced TBI and associated deaths has been rising at alarming rates, increasing by over 25% between 1989 and 1998. The risk for fall-related TBI increases substantially with age; persons over the age of 85 are hospitalized for fall-related TBI over twice as often as those aged 75-84, and over 6 times as often as those aged 65-74.

The financial burden associated with fall-related health care is significant. It is estimated the economic burden of fall-related injuries in Canada approximately $2 billion in annual treatment costs and is expected to rise to about $4.4 billion by 2031.

The costs to treat fall-related injuries in the United States are even higher. The average hospital cost for a fall injury in the US is over $30,000, and in 2015, costs for falls to Medicare alone totaled over $31 billion.

It would therefore be desirable to implement a surface, such as a flooring, underlayment system that will reduce impact forces and therefore reduce the potential risk of injury associated with fall-related impacts on the surface. Relatedly, it would be advantageous to have a low cost, low profile, durable safety flooring underlayment system that is compatible with sheet vinyl and carpet. Potential benefits include reducing injury risk due to falls on the flooring surface, minimizing system cost, maintaining system durability, facilitating installation, abating noise while offering surface quality and comfort for both patients and caregivers.

Flooring system manufacturers offer a variety of products to the commercial and residential market. These products include ceramic tile, solid wood, wood composites, carpet in rolls, carpet tiles, sheet vinyl, flexible vinyl tiles, rigid vinyl tiles, rubber sheet, rubber tiles, and the like.

Commercial flooring systems are typically installed directly over subfloors comprised of either rigid plywood or concrete. These systems are engineered to either be adhered/affixed directly to the subfloor or to float over the subfloor without being affixed to the subfloor. Products commonly affixed to the subfloor include ceramic tiles, vinyl tiles, sheet vinyl, carpet tiles, rubber tiles, wood flooring, and rubber sheet goods. Products that commonly float over the subflooring system are typically rigid and include luxury vinyl tile, rigid wood composites and plastic flooring tiles.

Further, some flooring constructions add a second layer or underlayment between the subfloor and the flooring system to either increase force distribution, enhance comfort under foot, abate noise within the room and through the flooring, or provide some additional insulation. This second layer can either be affixed to subfloor or float depending upon the recommendation of the system manufacturer.

While such underlayment layers provide some added benefit, they also increase system cost, installation complexity, and often reduce the durability of the top flooring material. To date, no commercially cost effective and durable underlayment system has been developed that provides a substantial injury risk reduction due to falls on the variety of flooring products. Several attempts have been made and are summarized below, but such approaches often fail to meet certain performance and cost effectiveness objectives.

Ecore® is a product manufactured from reconstituted tire rubber particles bound together into roll or sheet goods by a thermosetting polyurethane binder. Similar products are also offered by Cal Rubber and other manufacturers. The crumb rubber is bound using the polyurethane binder and extruded/calendared into sheet or roll stock of a given thickness. The thickness typically ranges from 5-10 mm. The Ecore rubber layer is adhered to thermally bonded to vinyl sheet flooring product to the rubber. The composite of rubber and vinyl is then bound to the subfloor using a cushioning and comfort under foot, they make sub-optimal contributions to the goals of cushioning a blow that accompanies a fall. The risk and severity of injury due to falls remain.

Smart Cells® is another product that is said to offer fall protection. Such technology was originally developed by Penn State University. The technology involves cylindrical columns of molded thermoset rubber consolidated into a sheet with interconnected ribbing between adjacent columns in a square array. The product is offered in heights of approximately 12 and 25 mm. The raw material is compression or injection molded under pressure until the structure crosslinks, to make a stable molded structure.

Installation of this material is labor intensive. Individual squares or rectangles of these molded structures are positioned adjacent to one another during installation. The material is not adhered to the floor. However, a binder adhesive is troweled onto the seams and allowed to cure prior to the application of a pressure sensitive of other bonding adhesive to adhere the final flooring surface to the SmartCells system. Once installed, the seams are prone to separation and read through to the A-surface. Finally, the system is expensive and at a premium that most facilities cannot afford.

Foams of various types have been considered for use in senior living facilities. However, these products are often so soft under foot that they promote instability. This reaction may be significant to someone whose balance may be impaired. Additionally, such structures are prone to compression set due to their cellular nature and do not return to their original shape after sustaining a point static loading for long periods. Such loading may be imposed by a bed, chair, or other heavy object. The entire flooring system is expected to withstand the rigors of daily traffic over these surfaces.

Injection molded tiles that snap into one another are often used for temporary or permanent flooring installations such as stage or dance floors, volleyball, basketball, garages, or other indoor flooring for sport surfaces. While the surfaces maybe acceptable from an appearance standpoint, they offer little force distribution or comfort characteristics. Furthermore, they often contain the moisture on or below the flooring surface. A water-tight system is unacceptable from a healthcare standpoint because there is a tendency for standing water to promote mold propagation, etc.

BRIEF SUMMARY OF THE INVENTION

Against this background, it would be desirable to develop a load distribution and absorption system that would underlay a superstructure material such as flooring system to mitigate injuries and soften footfalls, while reducing noise and vibration where possible.

Ideally, such a system would be of relatively low cost and present a low profile to minimize tripping, yet be durable. In several embodiments, an underlayment infrastructure would be compatible with a superstructure material such as sheet vinyl and carpet.

Among the goals are injury risk reduction due to falls on the flooring surface, minimizing system cost, maintaining system durability, facilitating installation, abating noise, yet retaining surface quality and comfort (in the case of elder care facilities) for patients and caregivers.

Accordingly, several embodiments of this disclosure include a load distributing and absorbing system that lies below a superstructure material which is exposed to continual or intermittent percussive forces. Often, such forces may cause a high localized pressure, such as when forces from a wheelchair are exerted via narrow wheels. The load distributing and absorbing system includes an underlayment infrastructure that is interposed between an underside of the superstructure material and a foundation below. In the underlayment infrastructure, load distribution is mainly provided by a barrier layer and load absorption is mainly provided by groups of absorbing members that are provided in tiles thereof (described below).

Most of the absorbing members have a ceiling which is positioned below the barrier layer. A continuous curvilinear wall extends from the ceiling. At the lower portion of the wall is a floor that lies above the foundation.

Tiles are united by inter-engagement of overlapping barrier layers that overlie the ceilings of adjacent tiles.

DETAILED DESCRIPTION OF THE INVENTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ alternative embodiments of this disclosure.

Figure 1:
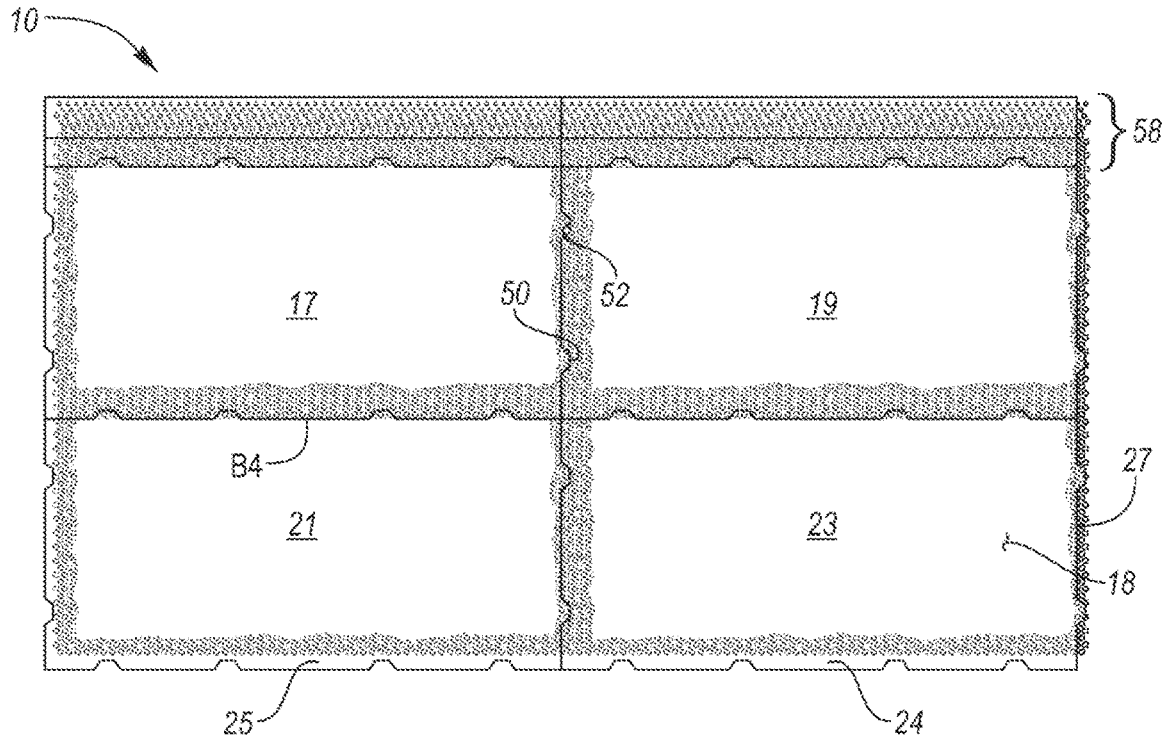
FIG. 1 is a top view of one embodiment of a load distributing and absorbing underlayment system that has four quadrilateral, preferably rectangular tiles.

FIG. 1 is a top view of one embodiment of a load distributing and absorbing underlayment system 10 that has four quadrilateral, preferably rectangular, tiles 17, 19, 21, 23. These tiles are positioned relative to one another by inter-engaging mating registration features 50, 52, including male 50 and female 52 features provided along the edges of a barrier layer 18. Each tile 17, 19, 21, 23 has an infrastructure 20 with a plurality of absorbing members 22 for load absorption and a barrier layer 18 for load distribution.

Figure 10:
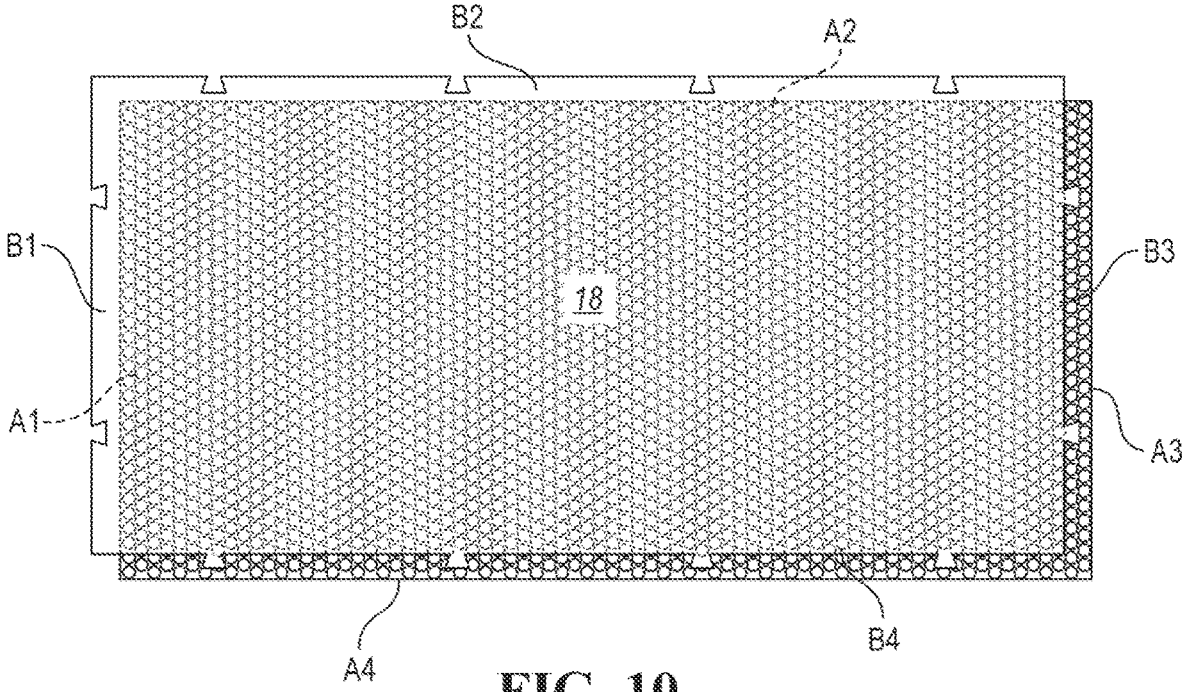
FIG. 10 represents an alternative design of barrier layer mating registration features.

Consider FIG. 10. The barrier layer 18 (in this case) is quadrilateral with edges B1, B2, B3 and B4. A sub-assembly of underlying absorbing members 22 includes individual members 22 that are conjoined by their ceilings 24 which, before for example thermoforming take the form of a planar basal sheet. The absorbing members 22 join together and coordinate to form a periphery of the sub-assembly that is quadrilateral and has edges A1, A2, A3 and A4. Each barrier layer 18 is securely affixed to one or more of the ceilings 24 in a tile. In some cases, the barrier layer 18 is affixed to one or more of the ceilings 24 by means for securing 55 such as an adhesive or by mechanical means including screws, rivets, pins and the like.

Figure 11:
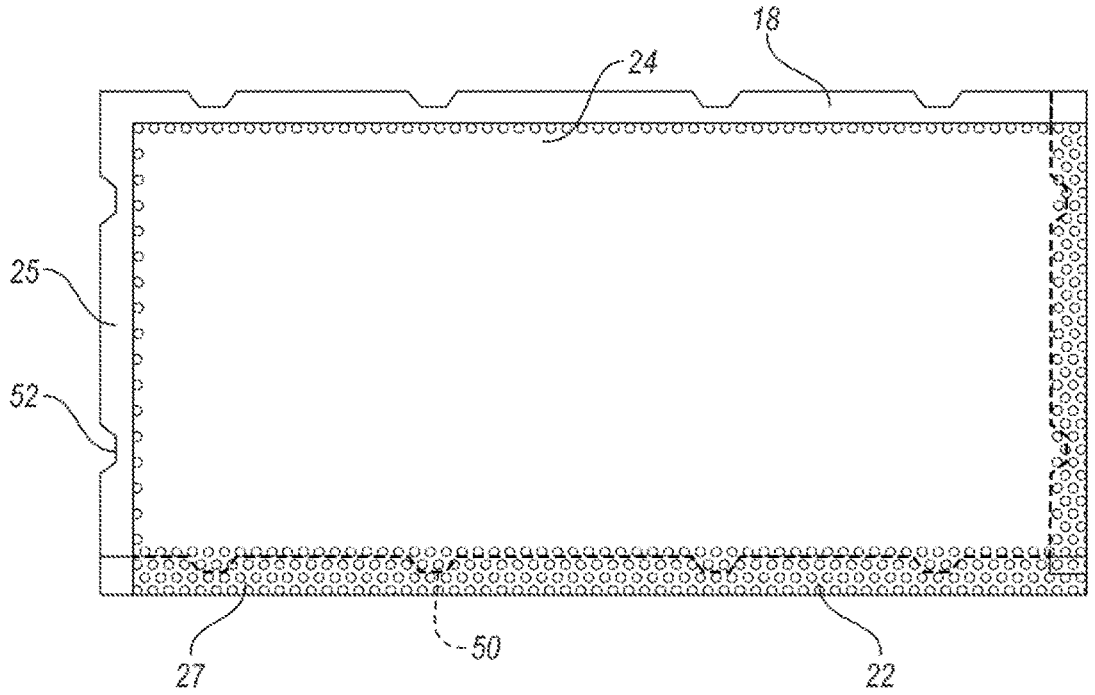
FIG. 11 illustrates a load distributing and absorbing system with a barrier layer where no adjacent tile exists and a pressure-sensitive adhesive is exposed on a tile edge.
Figure 12:
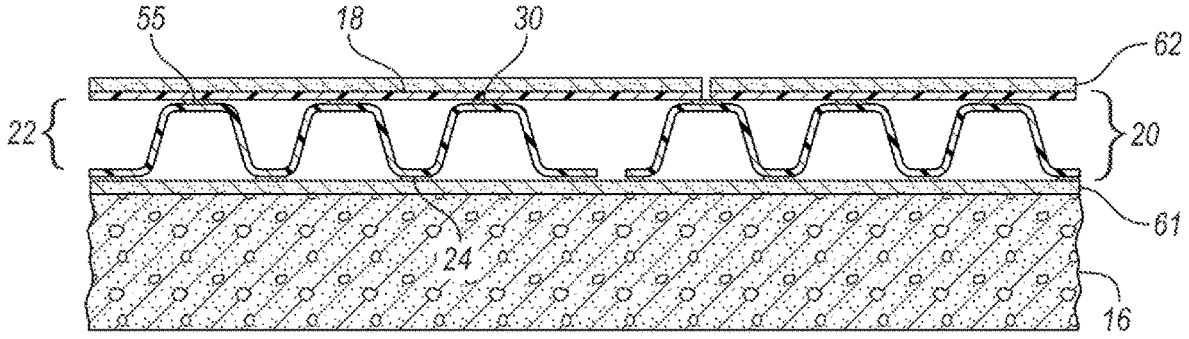
FIG. 12 shows an alternative (inverted) embodiment.

Edge B1 of the barrier layer 18 overhangs edge A1 of the sub-assembly of absorbing members 22 and edge B2 overhangs edge A2. Thus, edges A3 and A4 of the sub-assembly of absorbing members 22 extend beyond overlying edges B3 and B4 of the barrier layer 18. This arrangement creates an overhanging L-shaped platform 25 (FIGS. 1, 11) of the barrier layer 18 and an open L-shaped roof formed by the ceilings 24 of the absorbing members 22 in the sub-assembly. In adjacent tiles, the L-shaped roof 27 associated with a given tile 19 supports the L-shaped platform of the barrier layer 18 of an adjacent tile.

One consequence of this arrangement is that adjacent tiles engage each other in such a way as to inhibit relative lateral movement therebetween.

Figure 6:
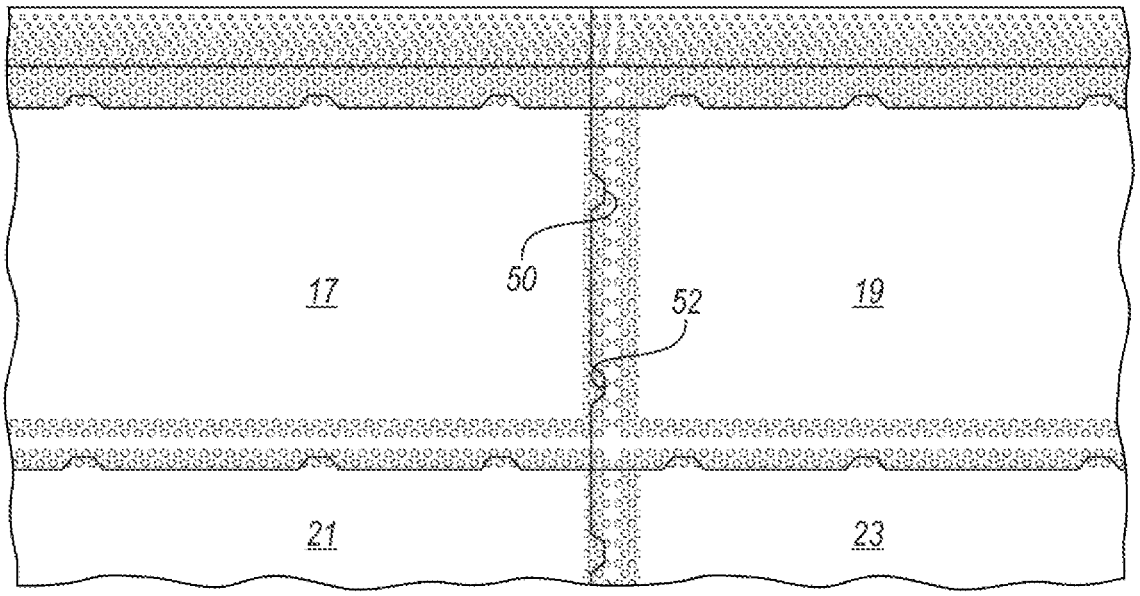
FIG. 6 shows a four-tile arrangement where adjacent tiles lie in the same orientation.
Figure 7:
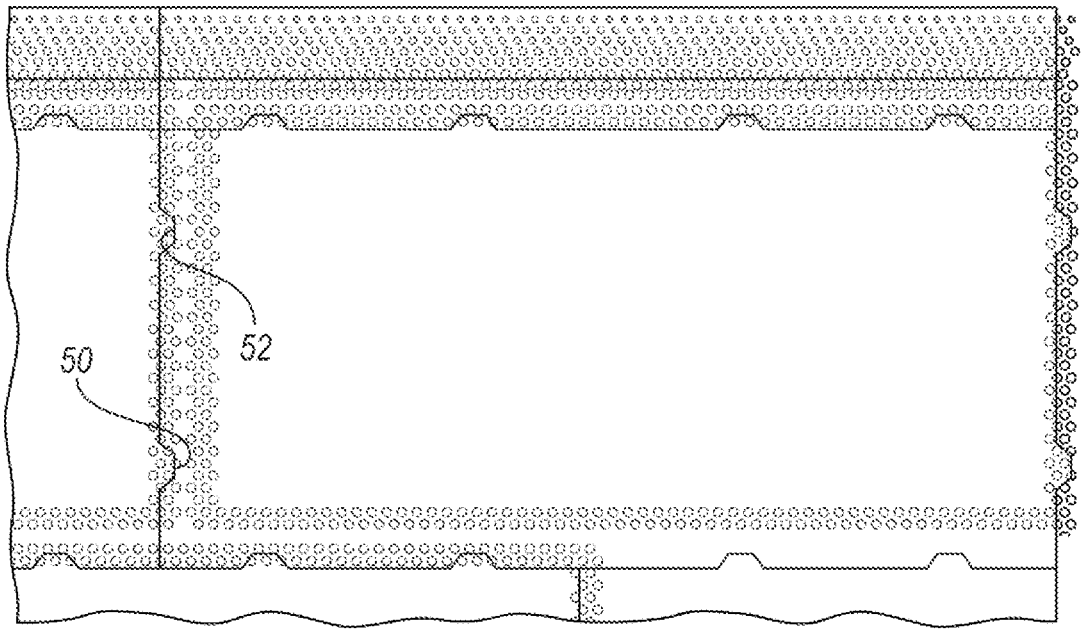
FIG. 7 suggests a three-seam intersection or staggered configuration of adjacent tiles.

Interlocking engagement of adjacent tiles in a group is provided by mating registration features 50, 52 (FIGS. 1, 6, 7). In a preferred embodiment, these mating registration features 50, 52 are trapezoidal in shape. For example, a male trapezoid 50 abuts a female trapezoid 52 along the edges of adjacent tiles 17, 19, 21, 23. It will be appreciated that there are alternative shapes of mating registration features, such as keyholes, sawtooth, semicircles, jigsaw-like pieces, etc.

Figure 2:
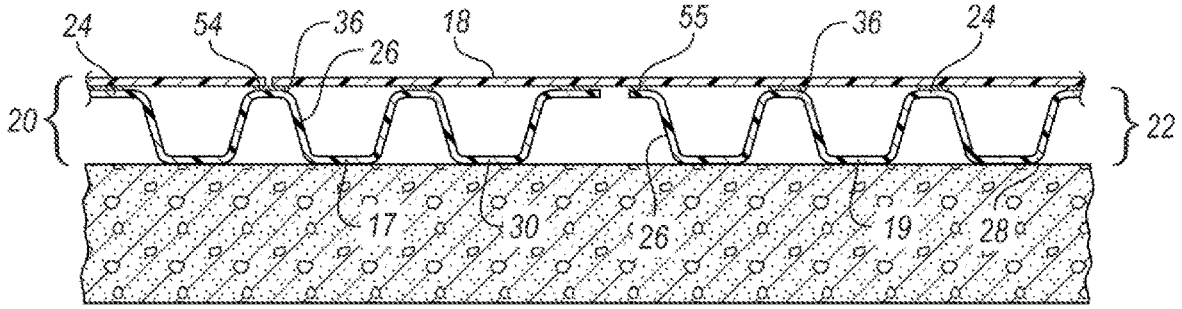
FIG. 2 is a sectional view through two illustrative adjacent abutted tiles.

FIG. 2 is a vertical sectional view through two illustrative adjacent abutted tiles, such as 17/19, 21/23, 17/21, 19/23 in FIG. 1. One version of an underlayment system 10 according to the present disclosure includes a barrier layer 18 which in some embodiments is in contact with the ceilings 24 of hat-shaped absorbing members 22.

As used herein the term "hat-shaped" includes frusto-conical. Such hat-shaped members 22 may have a lower portion 28 that has a footprint which is circular, oval, elliptical, a cloverleaf, a race track, or some other rounded shape with a curved perimeter. Similarly, for an upper portion 36 of an absorbing member 22. As used herein the term "hat-shaped" includes shapes that resemble those embodied in at least these hat styles: a boater/skimmer hat, a bowler/Derby hat, a bucket hat, a cloche hat, a fedora, a fez, a gambler hat, a homburg hat, a kettle brim or up-brim hat, an outback or Aussie hat, a panama hat, a pith helmet, a porkpie hat, a top hat, a steam punk hat, a safari hat or a trilby hat. See, e.g., https://www.hatsunlimited.com/hat-styles-guide, which is incorporated by reference.

As used herein the terms "hat-shaped" and "frusto-conical" exclude structures that include a ridge line or crease in a continuous curvilinear wall 26 associated with an absorbing member 22, because such features tend to promote stress concentration and lead to probable failure over time when exposed to percussive blows. They tend to concentrate, rather than distribute or absorb incident forces.

Connecting the ceiling 24 and the floor 30 of an absorbing member 22 is a curvilinear wall 26. When viewed laterally, a curvilinear wall 26 appears substantially linear or straight before being subjected to an impact force that may reign on a barrier layer 18. When viewed from above or below, the footprint of the lower portion 28 or upper portion 36 may appear circular, elliptical, oval, a clover leaf, a race-track or some other rounded shape with a curved perimeter.

The floor 30 or ceiling 24 of an absorbing member 22 may be flat or crenelated.

The absorbing members 22 may be manufactured from a resilient thermoplastic and be formed into frusto-conical or hat-shaped members 22 that protrude from a sheet which before exposure to a forming process is substantially flat.

In one preferred embodiment, the barrier layer 18 is made from a strong thin layer of a polycarbonate (PC), the absorbing member 22 is made from a resilient thermoplastic polyurethane (TPU), and the means for securing 55 is provided by a pressure sensitive adhesive (PSA) which bonds well to both the PC and TPU.

Thus, an underlayment infrastructure 20 is created by the juxtaposition of a barrier layer 18 and a sub-assembly of absorbing members 22.

An assembly of absorbing members 22 and overlying barrier layer 18 forms a tile 17, 19, 21, 23 (FIG. 1). Adjacent tiles are inter-engaged by overlapping and underlapping edges of the barrier layer 18 in the manner described above. Preferably, a small, but acceptable, gap exists between barrier layers 18 associated with adjacent tiles. The barrier layer 18 of one tile overlaps at least some of the exposed absorbing members 22 of an adjacent tile.

If desired, an adhesive 55 (FIG. 2) can be applied to one or both surfaces prior to the application of pressure which then adhesively attaches a barrier layer 18 to a tile 17, 19, 21, 23. adjacent tiles. An underlayment infrastructure 20 is thus assembled when the edges of adjacent tiles are brought into registration through the inter-engagement of mating registration features 50, 52 of adjacent edges of associated barrier layers 18.

While a pressure sensitive adhesive is a preferred embodiment of means for securing 55 a barrier layer 18 to the ceilings 24 of a tile, alternatives for attaching overlapped tiles together through their associated barrier layers 18 include mechanical means for attaching such as Velcro®, tape, rivets, etc.

The overlap of the barrier layers 18 and proximity of the absorbing members 22 on adjacent tiles distributes a load applied to the barrier layer 18 over a broad area. Loads are evenly distributed when applied either on a seam between adjacent tiles or within a tile. Loads are at least partially absorbed by flexure and possible rebound of the walls in the absorbing members.

Figure 3:
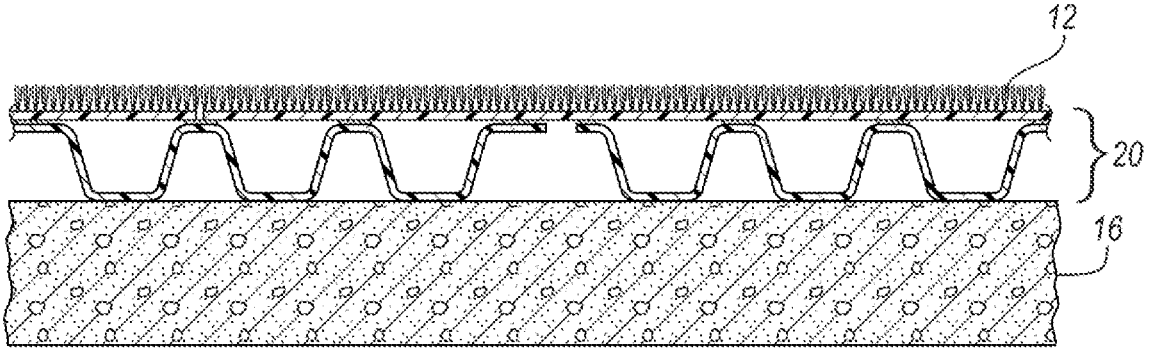
FIGS. 3-5 depict representative assembled flooring systems which include an underlayment infrastructure and a superstructure, such as three flooring products.
Figure 4:
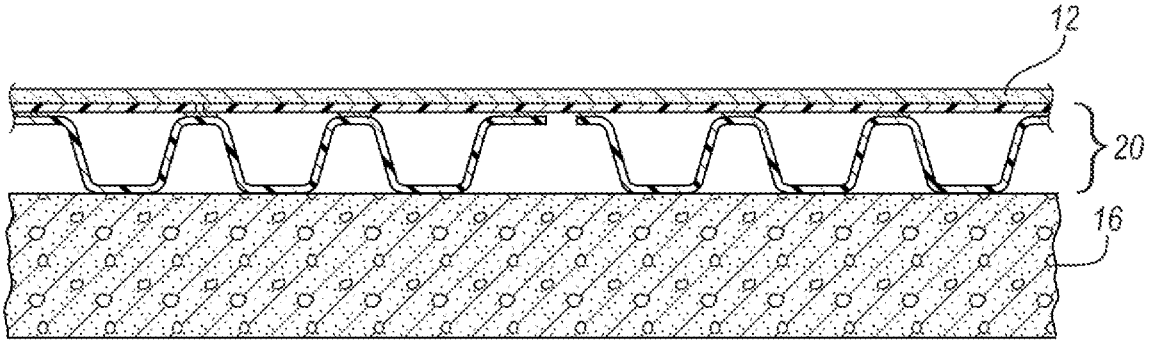
Figure 5:
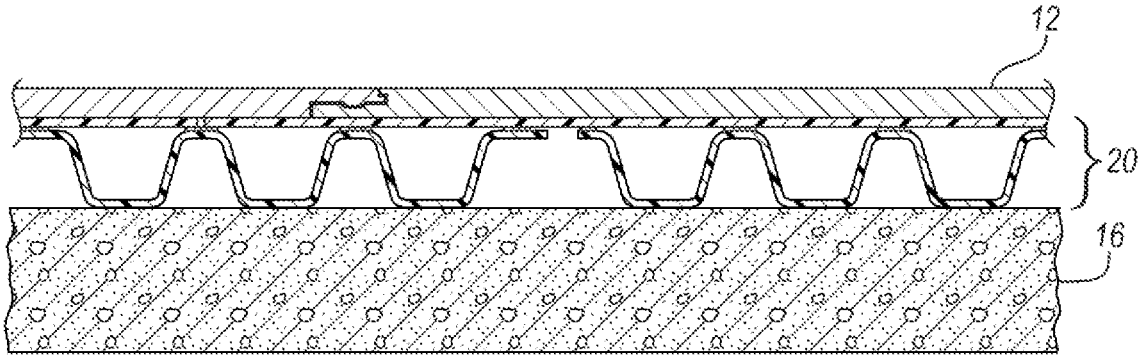

FIGS. 3, 4 and 5 depict a representative assembled flooring system which includes the underlayment infrastructure 20 and three superstructure materials 12, such as flooring products. Those figures depict a section through a typical carpet system (FIG. 3), a sheet vinyl or rubber system (FIG. 4), and rigid wood or composite tiles (FIG. 5). Commercial carpet systems are most often bonded directly to a foundation 16 or subfloor or to an underlayment material using an adhesive. Sheet vinyl or rubber are typically adhesively bonded to the underlayment material. The rigid wood or composite tiles may or may not be adhesively bonded to the underlayment material, depending on the product recommendations.

FIGS. 6 and 7 show two different tile orientations. FIG. 6 shows a four-tile arrangement 17, 19, 21, 23 where adjacent tiles lie in the same orientation. This orientation is preferred as it minimizes the number of edge cuts when the installation site is rectangular. FIG. 7 suggests a three-seam intersection or staggered configuration of adjacent tiles. The periodicity of the male 50 and female features 52 in the barrier layer 18 are engineered such that the tiles can be staggered relative to one another to create a "T" seam (FIG. 7) as opposed to a seam in the four-tile intersection (FIG. 6). Both configurations contemplate overlapping the barrier layer 18 of one tile with another (see also, e.g., FIG. 2).

It will be appreciated that in some applications, a given sub-assembly 54 absorbing members 22 may have more than one overlying barrier layer 18.

A preferred embodiment of the finished tiles is a 5 ft×2.5 ft rectangular tile. Tiles of this size can be delivered to the job site on densely packed pallets. They fit through any doorway. Alternatively, any number of polygonal arrangements of tiles including hexagons and the like could form a load distribution and absorbing system 10. However, the four-sided structures are preferred to conform with rectangular rooms.

Flooring systems are rarely uniformly dimensioned or shaped throughout a facility. Flooring transitions from one product to another often require a transition feature 58 (FIGS. 8, 9) to smoothly graduate from one height and type of product to a product of another type and height. In some cases, sheet vinyl flooring is usually around 2 mm in thickness. But rigid products can be as high as 8 or 9 mm. Commercial carpet often lies somewhere in between sheet vinyl and rigid.

Figure 8:
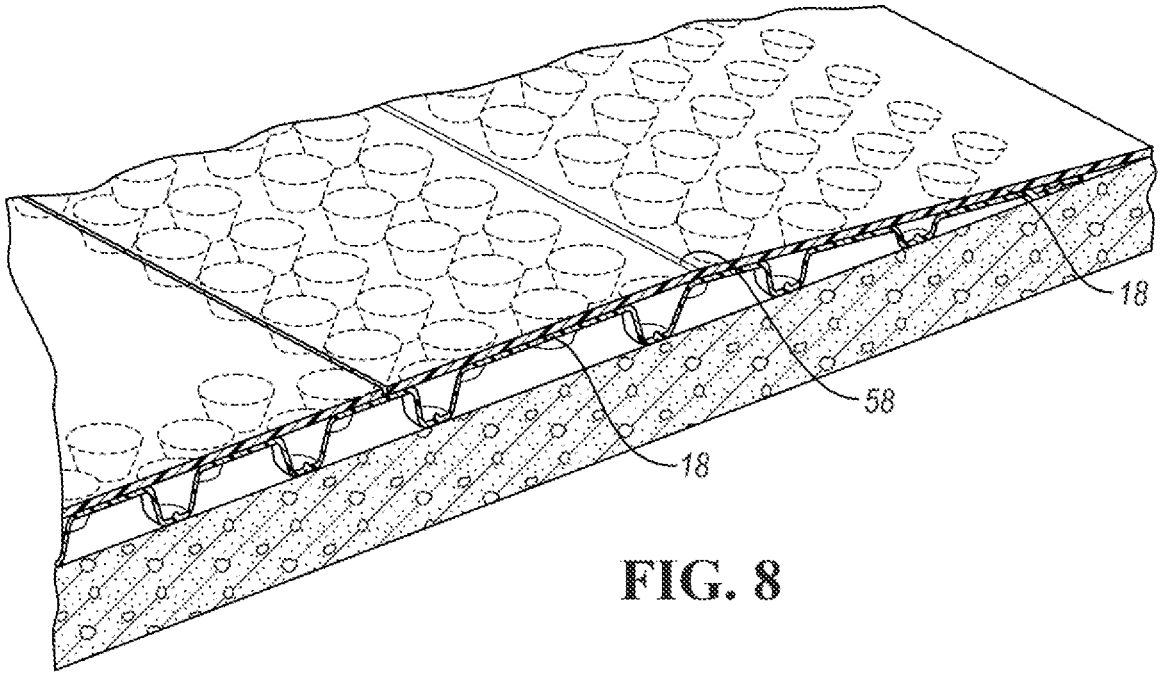
FIG. 8 depicts an illustrative height transition member that transitions from a higher safety flooring system to another flooring product that is lower in height.

FIG. 8 shows an illustrative engineered height transition 58 that transitions from an 11 mm safety flooring system to another flooring product that is lower in height. The transition from 11 mm to 1 mm over a length of approximately 150 mm meets the Americans with Disabilities Act (ADA) requirements for wheelchairs.

Figure 9:
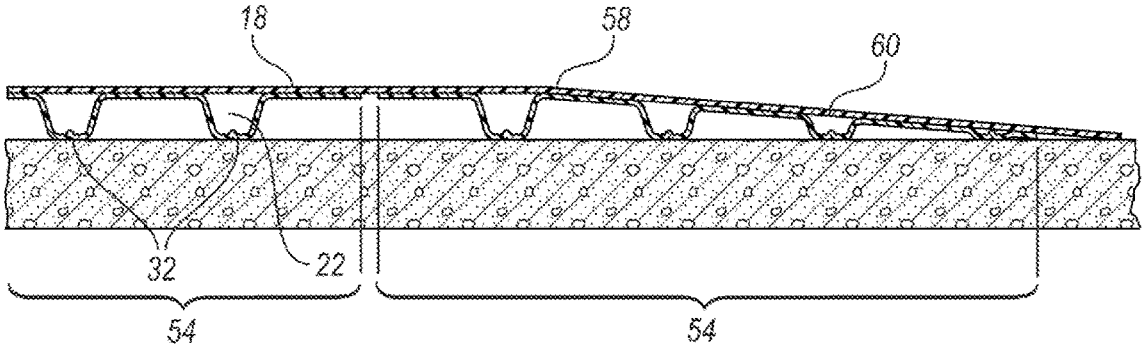
FIG. 9 is a cross sectional view of one transition feature overlapping an adjacent tile.

FIG. 9 is a cross sectional view of one transition feature 58 overlapping an adjacent tile. In such cases, the transition has a barrier layer 18 extending across the tiles which overlaps adjacent sub-assemblies 54 of absorbing members 22 and provides a sloped section 60 (FIG. 9) to transition down to an alternative construction. While the transition feature 58 could be positioned almost anywhere within a flooring surface, these transitions would often occur near a doorway from one room to the next. For example, a facility may choose to deploy carpet and underlayment in a patient room for comfort and sheet vinyl with no underlayment in a hallway. The transition feature 58 can be cut where the height matches the height of the adjacent flooring system.

In alternative embodiments, mating registration features 50, 52 may resemble jigsaw puzzle pieces or rectangles. Overlap of a barrier layer over an adjacent tile of absorbing members is facilitated by a tight gap between adjacent tiles. This feature helps avoid soft spots or read through defects in form and appearance. FIG. 10 represents one alternative interlock design.

The absorbing members 22 may be made from various materials. In a preferred example, they may be thermoformed from a resilient thermoplastic polyurethane from a 0.5 mm to 2.0 mm base stock. Such units may have a curvilinear wall 26 with 5 to 45 degrees of draft and be 5-30 mm in height. Such constructions are primarily suitable for commercial applications.

Other environments of deployment, such as residential, may require less durability and resiliency since they experience relatively little wear. In such cases, the absorbing members 22 or the barrier layer 18 could be produced from other less resilient and less expensive thermoplastics such polyethylene, polypropylene, acrylonitrile butadiene styrene, polycarbonate and the like. Residential applications may require less durability and resiliency since they experience only a fraction of the force distribution. Additionally, a casting or injection molding process could also be deployed to produce a similar product or structure.

For commercial applications, barrier layer materials 18 are preferably made of polycarbonate between 0.5 mm and 2.0 mm in thickness with a surface texture.

Alternative approaches to affixing the superstructure material 12 to the barrier layer 18 or the barrier layer to the ceiling 24 of an absorbing member 22 through means for securing 34 will now be described. Styrene butadiene rubber and polypropylene-based pressure sensitive adhesive, like HB Fuller 2081, is preferred over other adhesive types based on its affinity for both PC and TPU layers. Pressure sensitive adhesive is preferred over other types of adhesive systems as it allows for adjacent tiles to be adhered to one another with a pre-applied adhesive that requires only pressure to activate. Unlike rigid thermosetting adhesive systems, the PSA remains pliable over the life of the system. However, other adhesives could be utilized to permanently or temporarily bond the layers together. The HB Fuller adhesive preferred is specific to the materials of construction and an alternative might be better suited to a different build of materials.

Other applications for the disclosed load distributing and absorbing system 10 exist. It will be appreciated that this disclosure is mainly focused on fall protection for older adults or infirm patients in areas where slips and falls are prone to occur. However, it is conceivable that the system could be used in other applications or environments of use beyond fall protection. As non-limiting examples, these include work mats, blast mats, boat matting, work platforms, anti-fatigue mats, enhanced comfort mats, wall protection, playgrounds, day care floors, residences, sports surfaces, and other surfaces where those in contact with the surface might benefit from the technology.

The system 10 can be enhanced by further layers that provide an added function. The barrier layer 18 may include an additional layer of PSA film for the attachment of a superstructure material 12 such as a flooring surface or an additional sound abatement layer such as rubber, cork, vinyl barrier, and insulators. The absorbing members 22 may also have additional layers for sound abatement or adhesive.

In some cases, the load distributing and absorbing system 10 may benefit from the addition of a barrier layer 18 where no adjacent tile exists, and the PSA is exposed on a tile edge as in FIG. 10. Adding these pieces would be most logical starting from a wall edge so that the first piece does not need to be trimmed back and a full tile can be installed without trimming.

Advantages of the disclosed load distributing and absorbing system include:

Military grade impact protection for seniors;

Reduction in the risk of hip and other fractures due to falls;

Reduction in the risk of traumatic brain injury due to falls;

Reduction in fatigue with enhanced comfort under foot;

Stability under foot when and where desired;

Conformance of engineered transitions meet ADA accessibility requirements;

Enhanced sound absorption;

Enhanced vibration dampening;

Low profile for renovation or new construction;

Ease of installation;

Compatibility with conventional flooring adhesives;

Light weight;

Affordable;

Durable and capable of withstanding hundreds of impacts;

Can be installed over green concrete;

Provides additional thermal insulation;

Incorporates post-industrial content;

Acts as a vapor barrier.

Testing has demonstrated that use of various embodiments of the disclosed system may lead to a:

20-fold reduction in risk of critical head injury

60% reduction in the probability of moderate head injury 3-fold reduction in GMAX 2.5-fold reduction femoral neck force during falls for average older females 3-fold increase in force reduction 2.5-fold reduction in energy restitution firm and stable and stable surface that supports mobility substantially more comfort under foot for caregivers and older adults.

Test data indicate that the proposed load distributing and absorbing systems have the potential to substantially reduce the risk of injury and improve the quality of life for both older adults and caregivers.

TABLE OF REFERENCE NUMBERS

| Reference No. | Component |
|---|---|
| 10 | Load distributing and absorbing system |
| 12 | Superstructure material |
| 14 | Underside |
| 16 | Foundation |
| 17 | Tile |
| 18 | Barrier layer |
| 19 | Tile |
| 20 | Underlayment infrastructure |
| 21 | Tile |
| 22 | Absorbing members |
| 23 | Tile |
| 24 | Ceiling |
| 25 | Platform |
| 26 | Curvilinear wall |
| 27 | Roof |
| 28 | Lower portion |
| 30 | Floor |
| 32 | Apertures |
| 34 | Means for securing |
| 36 | Upper portion |
| 38 | Ceiling |
| 40 | Lower portion |
| 42 | Tiles of underlayment infrastructures |
| 44 | First tile |
| 46 | Edge |
| 48 | Adjacent tile |
| 50 | Male registration feature |
| 52 | Female registration feature |
| 54 | Sub-assemblies of absorbing members |
| 55 | Lower means for securing |
| 56 | Upper means for securing |
| 58 | Transition feature |
| 60 | Sloped section |
| 61 | Optional lower layer (e.g. sound or vibration dampening) |
| 62 | Optional upper layer |

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A load distributing and absorbing system that offers protection from injury following a fall, the system being located in a senior living environment or elder care facility, a hospital or an out-patient facility, a daycare facility, or a residential home, the load distributing and absorbing system lying below a barrier layer which is exposed to percussive or heavy point-applied forces exerted by the fall, a wheelchair, or a bed, the load distributing and absorbing system being interposed between the barrier layer and a foundation below, the load distributing and absorbing system comprising:

a plurality of load distributing and absorbing tiles, at least some of the tiles having an underlayment infrastructure positioned below the barrier layer, the underlayment infrastructure including one or more hat-shaped absorbing members, at least some of the hat-shaped absorbing members having a ceiling primarily for load distribution, the ceiling being positioned below the barrier layer;

a curvilinear wall primarily for load absorption extending from the ceiling, the curvilinear wall having a lower portion; and a floor that connects lower portions of the curvilinear walls of adjacent hat-shaped absorbing members within a tile, the floor lying above the foundation;

means for securing positioned between the barrier layer and a ceiling, wherein the means for securing includes a pressure-sensitive adhesive that provides securement by a pre-applied adhesive which requires pressure to activate and remains pliable after application, wherein the barrier layer of a first tile extends from two edges thereof and overhangs ceiling portions of two adjacent tiles to create an L-shaped platform that distributes a load between tiles that is applied to a central region of a tie or to a seam between adjacent tiles and promote inter-engagement of adjacent tiles without slippage, wherein at least some tiles are joined together by mating registration features proximate the edges of the barrier layers, the mating registration features being defined by a male feature extending from an edge of a barrier layer that engages a female feature defined within an edge of a barrier layer in an adjacent tile, thereby inhibiting relative lateral movement between adjacent tiles, so that the overhang of the barrier layers and proximity of the absorbing members on adjacent tiles distribute a load applied to the barrier layer over a broad area, thereby distributing the load when applied either on a seam between adjacent tiles or within a tile, so that an effect of applying a given point load to a central portion of a tile is substantially equivalent to applying the given point load to a seam between adjacent tiles, at least some of the absorbing members having a force-attenuation characteristic such that within a group of tiles, there is a user-determinable force attenuation property that may be uniform or varied within a tile or within a group of tiles or within both an individual tile and a group of tiles.

2. The load distributing and absorbing system of claim 1, wherein the barrier layer is selected from the group consisting of a ceramic tile, wood, a wood composite, a carpet, a carpet tile, sheet vinyl, a vinyl tile, a rigid vinyl tile, a rubber sheet, a rubber tile, a grating, and an anti-slip metallic surface.

3. The load distributing and absorbing system of claim 1, wherein the foundation includes concrete, a gravel, a metal and a hardwood.

4. The load distributing and absorbing system of claim 2, wherein the barrier layer includes a rigid thermoplastic.

5. The load distributing and absorbing system of claim 1, wherein at least some of the hat-shaped absorbing members have a configuration defined at least in part by an upper portion of a wall of an absorbing member that extends from a ceiling, a shape of the upper portion being selected from the group consisting of a circle, an oval, an ellipse, a clover leaf, a race-track, and other curved perimeters.

6. The load distributing and absorbing system of claim 1, wherein at least some of the hat-shaped absorbing members have a configuration defined at least in part by an imaginary footprint defined by the lower portion of a wall adjacent to the floor, the footprint being selected from the group consisting of a circle, an oval, an ellipse, a clover leaf, a race-track, and other curved perimeters.

7. A load distributing and absorbing infrastructure tile in a load distributing and absorbing system that lies below a barrier layer which is exposed to percussive or point-applied forces, the load distributing and absorbing infrastructure tile being interposed between the barrier layer and a foundation below, wherein the barrier layer distributes at least some of the percussive or point-applied forces and is quadrilateral with edges B1, B2, B3 and B4, the edges B1 and B2 including female registration features defined therewithin, the edges B3 and B4 including male registration features extending therefrom;

an absorbing member for absorbing at least some of the percussive or point-applied forces that is positioned below the barrier layer, the absorbing member being quadrilateral and having edges A1, A2, A3 and A4, the absorbing member including hat-shaped energy absorbing units, at least some of the hat-shaped energy absorbing units having a ceiling primarily for load distribution, the ceiling being positioned below the barrier layer;

a curvilinear wall primarily for load absorption, the curvilinear wall extending from the ceiling, the curvilinear wall having a lower portion; and a floor that connects the lower portions of the curvilinear wall of adjacent hat-shaped energy absorbing units, the floor lying above the foundation, wherein the barrier layer is positioned in relation to an absorbing member so that edge B1 of the barrier layer overhangs edge A1 of the absorbing member and edge B2 overlies edge A2, and edges A4 and A3 of the absorbing member extend beyond edges B4 and B3 of the barrier layer, thereby creating an L-shaped platform and an L-shaped roof that engage corresponding features of adjacent infrastructure tiles.

8. A load distributing and absorbing system comprising an assembly of inter-engaging load distributing and absorbing infrastructure tiles of claim 7.

9. The load distributing and absorbing system of claim 1, wherein the ceiling between the walls of an absorbing member in a tile has a length that is less than a length of the floor between adjacent absorbing members.

10. The load distributing and absorbing system of claim 1, further comprising one or more ribs extending at least partially between adjacent absorbing members.

11. The load distributing and absorbing system of claim 1, wherein the barrier layer includes:

a material selected from the group consisting of a floor located in a senior living or elder care facility;

a hospital or out-patient facility; a wall protection material;

a day care floor; and a flooring material in homes and residences.

12. A load distributing and absorbing system that lies below a barrier layer that is exposed to percussive or point-applied forces, the load distributing and absorbing system being interposed between the barrier layer and a foundation below, the load distributing and absorbing system comprising:

a plurality of load distributing and absorbing tiles, at least some of such tiles having an underlayment infrastructure positioned below the barrier layer, the underlayment infrastructure including one or more hat-shaped absorbing members, at least some of the hat-shaped absorbing members having an inverted ceiling, the inverted ceiling being positioned proximate the foundation;

a curvilinear wall extending above the ceiling;

an overlying floor primarily for load distribution, the floor being positioned below the barrier layer that connects facing sections of the curvilinear walls of adjacent hat-shaped absorbing members;

wherein the barrier layer of a first tile includes male and female registration features, extends from two edges of the first tile and overhangs at least some of the floors of hat-shaped absorbing members in an adjacent tile, so that overhang of the barrier layers and proximity of the absorbing members associated with adjacent tiles distribute a load applied to the barrier layer over a broad area, thereby distributing a load when applied either on a seam between adjacent tiles or within a tile.

13. The load distributing and absorbing system of claim 1, wherein the registration features are selected from a group consisting of trapezoids, keyholes, saw-teeth, semicircles, and shapes configured as mating pieces of a jigsaw puzzle, the registration features serving to avoid soft spots or read-through defects in form or appearance of the barrier layer.

14. The load distributing and absorbing system of claim 1, wherein the hat-shaped absorbing members have a shape selected from a group consisting of these hat styles: a boater/skimmer hat, a bowler/Derby hat, a bucket hat, a cloche hat, a fedora, a fez, a gambler hat, a homburg hat, a kettle brim or up-brim hat, an outback or Aussie hat, a Panama hat, a pit helmet, a porkpie hat, a top hat, a steampunk hat, a safari hat and a trilby hat.

15. The load distributing and absorbing system of claim 14, wherein the hat-shaped absorbing members lack a ridgeline or crease in the continuous curvilinear wall associated with an absorbing member, a presence of such features tending to promote stress concentration and leading to probable failure over time when exposed to percussive blows, the presence of such features tending to concentrate, rather than distribute or absorb incident forces.

16. The load distributing and absorbing system of claim 1, wherein the barrier layer is made from a strong, thin layer of a polycarbonate (PC) and the absorbing member is made from a resilient thermoplastic polyurethane (TPU).

* * * * *